US012709838B2

(12) United States Patent
Hamajima

(10) Patent No.: US 12,709,838 B2
(45) Date of Patent: Aug. 18, 2026

(54) COMPOSITION CONTAINING SIZING AGENT FOR INORGANIC FIBERS AND METHOD FOR PRODUCING INORGANIC FIBERS

(71) Applicant: Takemoto Oil & Fat Co., Ltd., Gamagori (JP)

(72) Inventor: Satoru Hamajima, Gamagori (JP)

(73) Assignee: Takemoto Oil & Fat Co., Ltd., Gamagori (JP)

( * ) Notice: Subject to any disclaimer, the term of this patent is extended or adjusted under 35 U.S.C. 154(b) by 0 days.

(21) Appl. No.: 18/855,827

(22) PCT Filed: Apr. 10, 2023

(86) PCT No.: PCT/JP2023/014488

§ 371 (c)(1),
(2) Date: Oct. 10, 2024

(87) PCT Pub. No.: WO2023/199878

PCT Pub. Date: Oct. 19, 2023

(65) Prior Publication Data

US 2025/0116061 A1 Apr. 10, 2025

(30) Foreign Application Priority Data

Apr. 15, 2022 (JP) ..... 2022-067617

(51) Int. Cl.
*D06M 15/59* (2006.01)
*D06M 101/40* (2006.01)

(52) U.S. Cl.
CPC ..... *D06M 15/59* (2013.01); *D06M 2101/40* (2013.01); *D06M 2200/40* (2013.01)

(58) Field of Classification Search
CPC ..... D06M 15/59; D06M 2101/40; D06M 2200/40
See application file for complete search history.

(56) References Cited

U.S. PATENT DOCUMENTS

| | | | | |
|---|---|---|---|---|
| 4,467,011 | A | 8/1984 | Brooks et al. | |
| 4,515,924 | A | 5/1985 | Brooks et al. | |
| 4,640,944 | A | 2/1987 | Brooks | |
| 5,230,956 | A | 7/1993 | Cole et al. | |
| 5,430,096 | A | 7/1995 | Hwang et al. | |
| 2015/0337108 | A1* | 11/2015 | Ieda | C08L 77/06 524/606 |
| 2016/0177049 | A1* | 6/2016 | Sakuma | C08K 5/17 524/236 |
| 2017/0275425 | A1* | 9/2017 | Sato | C08J 5/18 |

FOREIGN PATENT DOCUMENTS

| | | | |
|---|---|---|---|
| JP | S61-75880 | A | 4/1986 |
| JP | H01-38911 | B2 | 8/1989 |
| JP | H07-189134 | A | 7/1995 |
| JP | 8-503031 | A | 4/1996 |
| JP | 9-302585 | A2 | 11/1997 |
| JP | 2014-125688 | A | 7/2014 |
| JP | 2016-121318 | A | 7/2016 |
| JP | 6812046 | B1 | 1/2021 |

OTHER PUBLICATIONS

Extended European Search Report dated Jun. 27, 2025, in connection with European Application No. 23788296.4.
Hao-Jie et al., Preparation and Characterization of a polyimide coating on the surface of carbon fibers. New Carbon Materials. Apr. 1, 2015;30(2):115-21.
Chinese Office Action dated Aug. 23, 2025, in connection with Chinese Application No. 2023800329088, with English Translation thereof.
International Search Report and Written Opinion dated Jun. 20, 2023, in connection with International Application No. PCT/JP2023/014488, and English translation thereof.
Japanese Notice of Reasons for Refusal dated Jun. 14, 2022, in connection with Japanese Application No. 2022-067617, and English translation thereof.

* cited by examiner

*Primary Examiner* — Jeremy R Pierce
(74) *Attorney, Agent, or Firm* — Wolf, Greenfield & Sacks, P.C.

(57) ABSTRACT

Disclosed is an inorganic fiber sizing agent-containing composition that contains an inorganic fiber sizing agent and water. The inorganic fiber sizing agent contains a polyamide compound composed of a constituent unit A and a constituent unit B, and a nitrogen-containing compound. The molar ratio of the constituent unit A to the constituent unit B is constituent unit A/constituent unit B=49.0/51.0 to 43.0/57.0. The constituent unit A includes a constituent unit formed from a tetracarboxylic acid or a derivative thereof. The constituent unit B includes a constituent unit formed from a diamine or a derivative thereof. The nitrogen-containing compound is at least one selected from the group consisting of ammonia, a tertiary amine compound, and an aprotic nitrogen-containing heterocyclic compound. The mass ratio of the polyamide compound content to the nitrogen-containing compound content in the inorganic fiber sizing agent-containing composition is polyamide compound/nitrogen-containing compound=54/46 to 31/69.

8 Claims, No Drawings

COMPOSITION CONTAINING SIZING AGENT FOR INORGANIC FIBERS AND METHOD FOR PRODUCING INORGANIC FIBERS

This Application is a national stage filing under 35 U.S.C. 371 of International Patent Application Serial No. PCT/JP2023/014488, filed, Apr. 10, 2023, which claims priority to Japanese application number 2022-067617, filed, Apr. 15, 2022. The entire contents of these applications are incorporated herein by reference in their entirety.

TECHNICAL FIELD

The present invention relates to an inorganic fiber sizing agent-containing composition that contains water and that can achieve both an improvement in the heat resistance of the film obtained from the inorganic fiber sizing agent and an improvement in the long-term stability of the inorganic fiber sizing agent-containing composition, and to a method for producing an inorganic fiber using this composition.

BACKGROUND ART

Inorganic fibers, such as carbon fibers, are used as composite materials impregnated with a matrix resin such as an epoxy resin or as reinforcing fibers for concrete. In the case of carbon fibers, for example, a treatment is performed in which a carbon fiber sizing agent is adhered to the surface of the carbon fibers to impart properties such as bundling property to the carbon fiber strands.

Known inorganic fiber sizing agents are disclosed in Patent Documents 1 and 2. Patent Document 1 discloses a carbon fiber sizing agent used for reinforcing polyimide resins, in which a sizing agent composition containing a polymaleimide with a specific structure and an epoxy resin is applied to the carbon fiber. Patent Document 2 discloses a heat-stable fiber coated with a sizing composition containing a copolymer of a specific polyamide-amic acid A unit and a polyamide-imide B unit.

CITATIONS LIST

Patent Literature

Patent Document 1: Japanese Examined Patent Publication No. H01-38911

Patent Document 2: Japanese Laid-Open Patent Publication No. S61-75880

SUMMARY OF INVENTION

Technical Problem

However, these conventional inorganic fiber sizing agents have a problem in that it is difficult to achieve both an improvement in the heat resistance of the film obtained from the inorganic fiber sizing agent and an improvement in the long-term stability of a composition containing water and the inorganic fiber sizing agent.

Solution to Problem

As a result of research to solve the above problem, the inventor of the present application has found that an inorganic fiber sizing agent-containing composition that contains the polyamide compound and nitrogen-containing compound described below is particularly suitable.

In order to solve the above problem and in accordance with one aspect of the present invention, the inorganic fiber sizing agent-containing composition contains an inorganic fiber sizing agent and water. The inorganic fiber sizing agent contains a polyamide compound composed of a constituent unit A and a constituent unit B, and a nitrogen-containing compound. The molar ratio of the constituent unit A to the constituent unit B is constituent unit A/constituent unit B=49.0/51.0 to 43.0/57.0.

The constituent unit A includes a constituent unit formed from a tetracarboxylic acid or a derivative thereof.

The constituent unit B includes a constituent unit formed from a diamine or a derivative thereof.

The nitrogen-containing compound is at least one selected from the group consisting of ammonia, a tertiary amine compound, and an aprotic nitrogen-containing heterocyclic compound.

In the inorganic fiber sizing agent-containing composition, the constituent unit A may include a constituent unit formed from a tetracarboxylic acid having an aromatic group or a derivative thereof.

In the inorganic fiber sizing agent-containing composition, the constituent unit B may include a constituent unit formed from a diamine having an aromatic group or a derivative thereof.

In the inorganic fiber sizing agent-containing composition, the nitrogen-containing compound may include at least one selected from the group consisting of 1,2-dimethylimidazole and 1-piperidineethanol.

In the inorganic fiber sizing agent-containing composition, the mass ratio of the polyamide compound content to the nitrogen-containing compound content may be polyamide compound/nitrogen-containing compound=54/46 to 31/69.

In the inorganic fiber sizing agent-containing composition, the mass ratio of the inorganic fiber sizing agent to the water may be inorganic fiber sizing agent/water=10/90 to 80/20.

The inorganic fiber sizing agent-containing composition may be applied to a carbon fiber.

In order to solve the above problem and in accordance with another aspect of the present invention, the method for producing an inorganic fiber includes adhering the inorganic fiber sizing agent-containing composition to an inorganic fiber.

In the method for producing an inorganic fiber, the inorganic fiber may be a carbon fiber strand.

Advantageous Effects of Invention

According to the present invention, it is possible to achieve both an improvement in the heat resistance of the film obtained from an inorganic fiber sizing agent and an improvement in the long-term stability of a composition containing water and the inorganic fiber sizing agent.

DESCRIPTION OF EMBODIMENTS

First Embodiment

Firstly, a first embodiment of the inorganic fiber sizing agent-containing composition (hereinafter referred to as the "sizing agent composition") according to the present invention will be described. The sizing agent composition contains an inorganic fiber sizing agent (hereinafter referred to as the "sizing agent"), which contains a nitrogen-containing compound and a polyamide compound composed of constituent units A and B, and water as a solvent.

(Polyamide Compound)

The polyamide compound used in the present embodiment refers to a polyamic acid (polyimide precursor) in which a constituent unit A and a constituent unit B, described later, are polymerized via amide bonds. After being applied to an inorganic fiber as a water-containing dilution, this polyamide compound undergoes thermal dehydration and ring closure (imidization) under predetermined heating conditions, thereby forming a heat-resistant polyimide film.

The constituent unit A includes a constituent unit formed from a tetracarboxylic acid or a derivative thereof. The constituent unit A is not particularly limited as long as it is a compound capable of forming a polyamic acid (polyimide precursor) polymerized via an amide bond with the constituent unit B in the dilution in the presence of a nitrogen-containing compound.

The tetracarboxylic acid may be either a tetracarboxylic acid having an aromatic group or an aliphatic tetracarboxylic acid. Examples of the derivative of a tetracarboxylic acids include dianhydrides of tetracarboxylic acids and alkyl esters, such as methyl esters, of tetracarboxylic acids.

Specific examples of dianhydrides of tetracarboxylic acids having an aromatic group include pyromellitic dianhydride, 3,3',4,4'-biphenyltetracarboxylic dianhydride, 2,2',3,3'-biphenyltetracarboxylic dianhydride, 2,3,3',4'-biphenyltetracarboxylic dianhydride, 3,3',4,4'-biphenyltetracarboxylic dianhydride, hydroquinone-bis(trimellitate anhydride), methyl hydroquinone-bis(trimellitate anhydride), 3,3',4,4'-benzophenonetetracarboxylic dianhydride, 3,3',4,4'-biphenyl ether tetracarboxylic dianhydride, 3,3',4,4'-biphenylsulfonetetracarboxylic dianhydride, 2,2'-bis(3,4-dicarboxyphenyl) hexafluoropropanoic dianhydride, 2,2'-bis(3,4-dicarboxyphenyl) propanoic dianhydride, 1,4,5,8-naphthalenetetracarboxylic dianhydride, 2,3,6,7-naphthalenetetracarboxylic dianhydride, 4,4'-bis(1,3-dioxo-1,3-dihydroisobenzofuran-5-ylcarbonyloxy) biphenyl, 4,4'-bis(1,3-dioxo-1,3-dihydroisobenzofuran-5-ylcarbonyloxy)-3,3'-dimethylbiphenyl, 4,4"-bis(1,3-dioxo-1,3-dihydroisobenzofuran-5-ylcarbonyloxy)-3-methyl-p-terphenyl, and 4,4'''-bis(1,3-dioxo-1,3-dihydroisobenzofuran-5-ylcarbonyloxy)-3,3'''-dimethyl-p-quaterphenyl.

Specific examples of dianhydrides of aliphatic tetracarboxylic acids include bicyclo[2.2.2]oct-7-ene-2,3,5,6-tetracarboxylic dianhydride, 5-(dioxotetrahydrofuryl)-3-methyl-3-cyclohexene-1,2-dicarboxylic anhydride, 4-(2,5-dioxotetrahydrofuran-3-yl)-tetralin-1,2-dicarboxylic anhydride, tetrahydrofuran-2,3,4,5-tetracarboxylic dianhydride, bicyclo-3,3',4,4'-tetracarboxylic dianhydride, 1,2,4,5-cyclohexanetetracarboxylic dianhydride, 1,2,3,4-cyclobutanetetracarboxylic dianhydride, and 1,2,3,4-cyclopentanetetracarboxylic dianhydride.

The constituent unit A may be used singly or in combination of two or more types. Among them, it is preferable that the constituent unit is formed from a tetracarboxylic acid having an aromatic group or a derivative thereof, which can form a polyimide film with excellent heat resistance.

The constituent unit B includes a constituent unit formed from a diamine or a derivative thereof. The constituent unit B is not particularly limited as long as it is a compound capable of forming a polyamic acid (polyimide precursor) polymerized via an amide bond with the constituent unit A in the sizing agent composition in the presence of a nitrogen-containing compound. The diamine or a derivative thereof may be either a diamine having an aromatic group or an aliphatic diamine.

Specific examples of diamines having an aromatic group include p-phenylenediamine, m-phenylenediamine, 4,4'-diaminodiphenyl ether, 3,3'-diaminodiphenyl ether, 3,4'-diaminodiphenyl ether, 2,4-diaminotoluene, 2,5-diaminotoluene, 2,4-diaminoxylene, 2,4-diaminodurene, 4,4'-diaminodiphenylmethane, 4,4'-methylenebis(2-methylaniline), 4,4'-methylenebis(2-ethylaniline), 4,4'-methylenebis(2,6-dimethylaniline), 4,4'-methylenebis(2,6-diethylaniline), 4,4'-oxydianiline, 3,4'-oxydianiline, 3,3'-oxydianiline, 2,4'-oxydianiline, 4,4'-diaminodiphenylsulfone, 3,3'-diaminodiphenylsulfone, 4,4'-diaminobenzophenone, 3,3'-diaminobenzophenone, 4,4'-diaminobenzanilide, 4-aminophenyl-4'-aminobenzoate, benzidine, 3,3'-dihydroxybenzidine, 3,3'-dimethoxybenzidine, o-tolidine, m-tolidine, 2,2'-bis(trifluoromethyl)benzidine, 1,4-bis(4-aminophenoxy)benzene, 1,3-bis(4-aminophenoxy)benzene, 1,3-bis(3-aminophenoxy)benzene, 4,4'-bis(4-aminophenoxy) biphenyl, bis(4-(3-aminophenoxy) phenyl) sulfone, bis(4-(4-aminophenoxy)phenyl) sulfone, 2,2-bis(4-(4-aminophenoxy)phenyl) propane, 2,2-bis(4-(4-aminophenoxy)phenyl) hexafluoropropane, 2,2-bis(4-aminophenyl) hexafluoropropane, and p-terphenylenediamine.

Specific examples of aliphatic diamines include 4,4'-methylenebis(cyclohexylamine), isophoronediamine, trans-1,4-diaminocyclohexane, cis-1,4-diaminocyclohexane, 1,4-cyclohexanbis(methylamine), 2,5-bis(aminomethyl)bicyclo[2.2.1]heptane, 2,6-bis(aminomethyl)bicyclo[2.2.1]heptane, 3,8-bis(aminomethyl)tricyclo[5.2.1.0]decane, 1,3-diaminoadamantane, 2,2-bis(4-aminocyclohexyl) propane, 2,2-bis(4-aminocyclohexyl)hexafluoropropane, 1,3-propanediamine, 1,4-tetramethylenediamine, 1,5-pentamethylenediamine, 1,6-hexamethylenediamine, 1,7-heptamethylenediamine, 1,8-octamethylenediamine, and 1,9-nonamethylenediamine.

The constituent unit B may be used singly or in combination of two or more types. Among them, it is preferable to include a constituent unit formed from a diamine having an aromatic group or a derivative thereof, which can form a polyimide film with excellent heat resistance.

The molar ratio of the constituent unit A to the constituent unit B in the blended raw materials is constituent unit A/constituent unit B=49.0/51.0 to 43.0/57.0. A sizing agent composition containing the polyamide compound synthesized within this range can particularly improve long-term stability.

(Nitrogen-Containing Compound)

Examples of the nitrogen-containing compound used in the present embodiment include ammonia, a tertiary amine compound, and an aprotic nitrogen-containing heterocyclic compound.

Specific examples of the tertiary amine compound include 1-piperidineethanol, N-methylpyrrolidone, N,N-dimethylacetamide, N,N-diethylacetamide, dimethylformamide, hexamethylphosphoramide, 1,3-dimethyl-2-imidazolidinone, dimethylaminoethanol, diethylaminoethanol, diisopropylaminoethanol, triethanolamine, dimethylethanolamine, diethylethanolamine, dibutylethanolamine, tetramethylethylenediamine, triethylenediamine, N-methylmorpholine, N-ethylmorpholine, dimethylbenzylamine, N,N,N',N'-tetramethyl-1,6-diaminohexane, N,N,N',N"N"-pentamethyldiethylenetriamine, bis-(2-dimethylaminoethyl) ether, and 1,8-diazabicyclo[5.4.0]undecene-7.

Specific examples of the aprotic nitrogen-containing heterocyclic compound include picoline, pyridine, N,N-dimethyl-4-aminopyridine, 1,2-dimethylimidazole, and N-methylimidazole. Some aprotic nitrogen-containing compounds are also tertiary amine compounds.

The nitrogen-containing compounds may be used singly or in combination of two or more types.

Among the nitrogen-containing compounds, 1,2-dimethylimidazole and 1-piperidineethanol are preferable. The use of these compounds can further improve the long-term stability of the sizing agent composition.

The mass ratio of the polyamide compound content to the nitrogen-containing compound content in the sizing agent composition is appropriately set, but it is preferably polyamide compound/nitrogen-containing compound=54/46 to 30/70, and more preferably polyamide compound/nitrogen-containing compound=54/46 to 31/69. A range can also be defined by any combination of the above upper and lower limits. By setting the mass ratio within such a range, the long-term stability can be particularly improved.

(Water)

The mass ratio of the sizing agent to the water in the sizing agent composition is appropriately set, but it is preferably sizing agent/water=5/95 to 85/15, and more preferably sizing agent/water=10/90 to 80/20. A range can also be defined by any combination of the above upper and lower limits. By setting the mass ratio within such a range, the long-term stability can be particularly improved.

A polyamic acid (polyimide precursor) as a polyamide compound is synthesized by dissolving or suspending the constituent unit A and the constituent unit B in water in the presence of a nitrogen-containing compound, and then promoting a polymerization reaction via amide bonds under heating conditions of, for example, 50° C. or higher and 80° C. or lower, preferably 60° C. or higher and 70° C. or lower, for, for example, 1 hour or longer and 10 hours or shorter, preferably 5 hours or longer and 7 hours or shorter. The water content of the sizing agent composition, which contains the polyamide compound obtained by the polymerization reaction, the nitrogen-containing compound added during the reaction, and water, may be adjusted as necessary.

Second Embodiment

Next, a second embodiment of the method for producing an inorganic fiber according to the present invention will be described. The method for producing an inorganic fiber of the present embodiment includes adhering the sizing agent composition of the first embodiment to a carbon fiber. The adhesion amount (excluding the solvent) is not particularly limited, but it is preferable to adhere the sizing agent to the inorganic fiber such that the adhesion amount of the sizing agent is 0.01% by mass or more and 10% by mass or less. By specifying the adhesion amount within such a numerical range, effects such as the bundling property of the inorganic fiber can be further improved. The types of inorganic fiber applicable in the present embodiment are not particularly limited, and examples thereof include glass fiber, carbon fiber, ceramic fiber, metal fiber, mineral fiber, rock fiber, and slag fiber. Among them, a carbon fiber is preferable, and a carbon fiber strand is more preferable from the viewpoint of more effectively exhibiting the effects of the present invention. Examples of types of carbon fiber include PAN-based carbon fiber obtained using acrylic fiber as a raw material, pitch-based carbon fiber obtained using pitch as a raw material, recycled carbon fiber, and carbon fiber obtained using polyester fiber as a raw material.

In order to obtain an inorganic fiber by adhering the sizing agent composition of the first embodiment to the inorganic fiber, methods generally used industrially can be employed. Examples of such methods include a roller immersion method, a roller contact method, a spraying method, and a papermaking method. The inorganic fiber to which the sizing agent composition of the first embodiment has been adhered is subsequently subjected to a drying treatment to remove water, nitrogen-containing compounds, and the like contained in the sizing agent composition, whereby an inorganic fiber can be obtained. As the drying treatment here, for example, methods using hot air, hot plates, rollers, various infrared heaters, or the like as heat media can be employed. The treatment temperature of the drying process is preferably 130° C. or higher and 220° C. or lower. With such a temperature range, the polyamic acid undergoes thermal dehydration and ring closure (imidization), thereby forming a heat-resistant polyimide film.

(Operation)

Next, the operations of the sizing agent composition and the method for producing a carbon fiber configured as described above will be described below.

In the above embodiments, a sizing agent containing a polyamide compound composed of the aforementioned constituent unit A and constituent unit B, and the aforementioned nitrogen-containing compound, is employed.

For example, when 3,3',4,4'-biphenyltetracarboxylic anhydride is used as the constituent unit A, paraphenylenediamine is used as the constituent unit B, and 1,2-dimethylimidazole is used as the nitrogen-containing compound, the polyamic acid (polyimide precursor) is synthesized as the polyamide compound by the following method. That is, first, paraphenylenediamine and 1,2-dimethylimidazole are dissolved in water. Next, 3,3',4,4'-biphenyltetracarboxylic anhydride is suspended, and the polymerization reaction via amide bonds is promoted at 50° C. or higher and 80° C. or lower for 1 hour or longer and 10 hours or shorter. As a result, polyamic acid (polyimide precursor) is synthesized as a polyamide compound through the reaction shown in the following Chemical Formula 1.

[Chemical Formula 1]

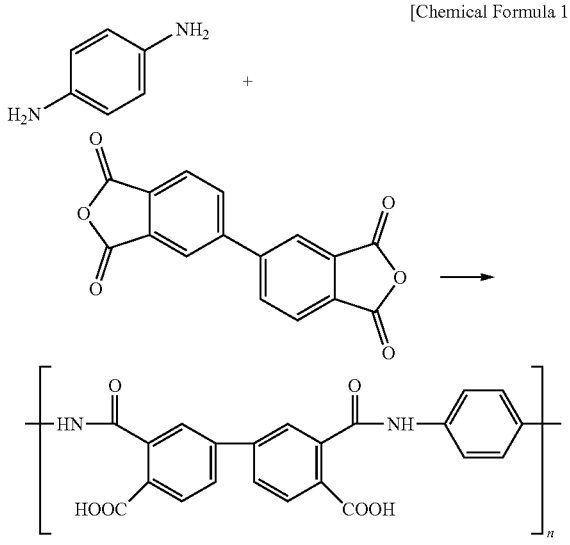

The sizing agent composition containing a polyamide compound is adhered to an inorganic fiber, and after that, it is subjected to a drying treatment under predetermined temperature conditions, for example, at 130° C. or higher and 220° C. or lower. At that time, as shown in Chemical Formula 2 below, a heat-resistant polyimide film is formed by heating to cause thermal dehydration and ring closure (imidization).

[Chemical Formula 2]

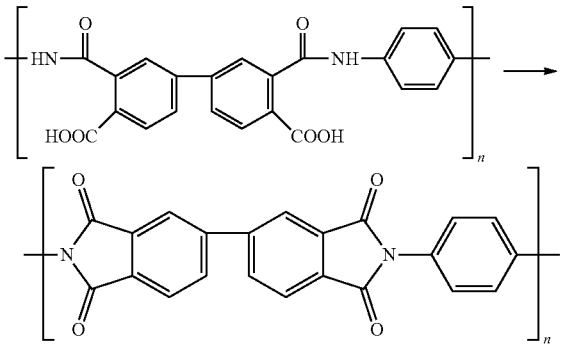

The molar ratio of the constituent unit A to the constituent unit B in the blended raw materials is defined within the range of constituent unit A/constituent unit B=49.0/51.0 to 43.0/57.0. Therefore, the constituent unit B is positioned at the terminal ends of the main polymer produced. In addition, a polymer with a molecular weight preferable for exhibiting heat resistance and long-term stability is obtained. Consequently, the reactivity of the polymer during the storage period can be suppressed, improving long-term storage stability. Furthermore, a polymer excellent in heat resistance is obtained.

According to the sizing agent composition and the method for producing a carbon fiber of the above embodiments, the following effects can be obtained.

In the above embodiments, the sizing agent composition contains water and a sizing agent, which contains the aforementioned nitrogen-containing compound and a polyamide compound in which the molar ratio of the aforementioned constituent unit A to constituent unit B in the blended raw materials is defined as constituent unit A/constituent unit B=49.0/51.0 to 43.0/57.0. Therefore, it is possible to achieve both an improvement in the heat resistance of the film obtained from the inorganic fiber sizing agent and an improvement in the long-term stability of a composition containing water and the inorganic fiber sizing agent. The above embodiments may be modified as follows.

From the viewpoint of maintaining the performance of the sizing agent composition without inhibiting the effects of the present invention, the sizing agent composition of the above embodiment does not preclude the blending of another component such as a surfactant, a trace amount of an organic solvent, a smoothing agent, an antioxidant, or a preservative.

The field to which the inorganic fiber of the above embodiment is applied is not particularly limited. For example, it may be applied to carbon fiber composite materials (CFRP) impregnated with a matrix resin such as a polyimide resin, reinforcing fiber for concrete, and the like.

EXAMPLES

Examples are provided below to more specifically illustrate the features and effects of the present invention; however, the invention is not limited to these examples. In the following descriptions of the examples and comparative examples, part(s) refers to part(s) by mass, and % refers to % by mass.

Experimental Part 1 (Preparation of Sizing Agent Composition)

Preparation of Sizing Agent Composition of Example 1

In a glass reaction vessel with an internal volume of 500 mL, 360 g of water as a solvent was added. To this, 8.29 g of 4,4'-diaminodiphenyl ether as a constituent unit B and 20.00 g of 1,2-dimethylimidazole as a nitrogen-containing compound were added, and the mixture was stirred at 25° C. for 1 hour to dissolve. To this solution, 11.71 g of 3,3',4,4'-biphenyltetracarboxylic dianhydride as a constituent unit A was added, and the mixture was stirred at 70° C. for 6 hours to synthesize a polyamide compound (polyamic acid as a polyimide precursor) (P-1), thereby obtaining a sizing agent composition of Example 1.

Preparation of Sizing Agent Compositions of Examples 2 to 49

In the same manner as the sizing agent composition of Example 1, polyamide compounds (P-2) to (P-22) were synthesized by combining the constituent unit A and the constituent unit B, which form the polyamide compounds (P-1) to (P-22) listed in Table 1, with the nitrogen-containing compounds shown in Table 2. At the same time, the sizing agent compositions of Examples 2 to 49 were prepared.

Preparation of Sizing Agent Compositions of Comparative Examples 1 to 6

The combinations of the constituent unit A and the constituent unit B, which form the polyamide compounds (P-3) and (rp-1) to (rp-3) listed in Table 1, with the nitrogen-containing compounds listed in Table 2 were applied. Sizing agent compositions of Comparative Examples 1 to 6 were prepared by performing the reaction in the same manner as in the sizing agent composition of Example 1.

For the polyamide compounds (P-1) to (P-22) and (rp-1) to (rp-3) described above, the ratios (molar ratios) of the constituent unit A, the constituent unit B, and the raw materials used are shown in the column "constituent unit A," the column "constituent unit B," and the column "constituent unit A/constituent unit B (molar ratio)" in Table 1 below.

The type and content of the polyamide compound, the type and content of the nitrogen-containing compound, and the content of water in the sizing agent composition of each example are shown in the column "polyamide compound," the column "nitrogen-containing compound," and the column "water" in Table 2, respectively. The mass ratio of the polyamide compound content to the nitrogen-containing compound content is shown in the column "polyamide compound/nitrogen-containing compound (mass ratio)."

TABLE 1

| Section | Constituent unit A | Constituent unit B | Constituent unit A/ Constituent unit B (Molar ratio) |
|---|---|---|---|
| P-1 | 3,3',4,4'-Biphenyltetracarboxylic dianhydride | 4,4'-Diaminodiphenyl ether | 49.0/51.0 |
| P-2 | 3,3',4,4'-Biphenyltetracarboxylic dianhydride | 4,4'-Diaminodiphenyl ether | 48.0/52.0 |
| P-3 | 3,3',4,4'-Biphenyltetracarboxylic dianhydride | 4,4'-Diaminodiphenyl ether | 46.7/53.3 |
| P-4 | 3,3',4,4'-Biphenyltetracarboxylic dianhydride | 4,4'-Diaminodiphenyl ether | 46.2/53.8 |
| P-5 | 3,3',4,4'-Biphenyltetracarboxylic dianhydride | 4,4'-Diaminodiphenyl ether | 45.5/54.5 |
| P-6 | 3,3',4,4'-Biphenyltetracarboxylic dianhydride | 4,4'-Diaminodiphenyl ether | 44.4/55.6 |
| P-7 | 3,3',4,4'-Biphenyltetracarboxylic dianhydride | 4,4'-Diaminodiphenyl ether | 43.0/57.0 |
| P-8 | 2,2',3,3'-Biphenyltetracarboxylic dianhydride | 3,3'-Diaminodiphenyl ether | 46.7/53.3 |
| P-9 | 2,2',3,3'-Biphenyltetracarboxylic dianhydride | 3,4'-Diaminodiphenyl ether | 46.7/53.3 |
| P-10 | 2,2',3,3'-Biphenyltetracarboxylic dianhydride | 4,4'-Diaminodiphenyl ether | 46.7/53.3 |
| P-11 | 2,3,3',4'-Biphenyltetracarboxylic dianhydride | 3,3'-Diaminodiphenyl ether | 46.7/53.3 |
| P-12 | 2,3,3',4'-Biphenyltetracarboxylic dianhydride | 3,4'-Diaminodiphenyl ether | 46.7/53.3 |
| P-13 | 2,3,3',4'-Biphenyltetracarboxylic dianhydride | 4,4'-Diaminodiphenyl ether | 46.7/53.3 |
| P-14 | 3,3',4,4'-Biphenyltetracarboxylic dianhydride | 3,3'-Diaminodiphenyl ether | 46.7/53.3 |
| P-15 | 3,3',4,4'-Biphenyltetracarboxylic dianhydride | 3,4'-Diaminodiphenyl ether | 46.7/53.3 |
| P-16 | 1/1 (molar ratio) Mixture of 3,3',4,4'-biphenyltetracarboxylic dianhydride and pyromellitic dianhydride | 4,4'-Diaminodiphenyl ether | 46.7/53.3 |
| P-17 | 1/1 (molar ratio) Mixture of 3,3',4,4'-biphenyltetracarboxylic dianhydride and 2,3,6,7-naphthalenetetracarboxylic dianhydride | 4,4'-Diaminodiphenyl ether | 46.7/53.3 |
| P-18 | 3,3',4,4'-Biphenyltetracarboxylic dianhydride | 1/1 (molar ratio) Mixture of 4,4'-diaminodiphenyl ether and paraphenylenediamine | 46.7/53.3 |
| P-19 | 3,3',4,4'-Biphenyltetracarboxylic dianhydride | 1/1 (molar ratio) Mixture of 4,4'-diaminodiphenyl ether and meta-phenylenediamine | 46.7/53.3 |
| P-20 | 1,2,4,5-Cyclohexanetetracarboxylic dianhydride | 4,4'-Diaminodiphenyl ether | 46.7/53.3 |
| P-21 | 3,3',4,4'-Biphenyltetracarboxylic dianhydride | 1,4-Diaminocyclohexane | 46.7/53.3 |
| P-22 | 1,2,4,5-Cyclohexanetetracarboxylic dianhydride | 1,4-Diaminocyclohexane | 46.7/53.3 |
| rp-1 | 3,3',4,4'-Biphenyltetracarboxylic dianhydride | 4,4'-Diaminodiphenyl ether | 50.0/50.0 |
| rp-2 | 3,3',4,4'-Biphenyltetracarboxylic dianhydride | 4,4'-Diaminodiphenyl ether | 42.9/57.1 |
| rp-3 | 3,3',4,4'-Biphenyltetracarboxylic dianhydride | 4,4'-Diaminodiphenyl ether | 54.5/45.5 |

TABLE 2

| | Inorganic fiber sizing agent-containing composition | | | | | Polyamide compound/ nitrogen-containing compound | Evaluation | |
|---|---|---|---|---|---|---|---|---|
| | Inorganic fiber sizing agent | | | | | | | |
| | Polyamide compound | | Nitrogen-containing compound | | Water | (Mass | Heat | Long-term |
| Section | Type | Part | Type | Part | Part | ratio) | resistance | stability |
| Example 1 | P-1 | 5 | C-1 | 5 | 90 | 50/50 | ◎◎ | ◎◎◎ |
| Example 2 | P-2 | 5 | C-1 | 5 | 90 | 50/50 | ◎◎ | ◎◎◎ |
| Example 3 | P-3 | 5 | C-1 | 5 | 90 | 50/50 | ◎◎ | ◎◎◎ |
| Example 4 | P-4 | 5 | C-1 | 5 | 90 | 50/50 | ◎◎ | ◎◎◎ |
| Example 5 | P-5 | 5 | C-1 | 5 | 90 | 50/50 | ◎◎ | ◎◎◎ |
| Example 6 | P-6 | 5 | C-1 | 5 | 90 | 50/50 | ◎◎ | ◎◎◎ |
| Example 7 | P-7 | 5 | C-1 | 5 | 90 | 50/50 | ◎◎ | ◎◎◎ |
| Example 8 | P-8 | 5 | C-1 | 5 | 90 | 50/50 | ◎◎ | ◎◎◎ |
| Example 9 | P-9 | 5 | C-1 | 5 | 90 | 50/50 | ◎◎ | ◎◎◎ |
| Example 10 | P-10 | 3.2 | C-1 | 6.8 | 90 | 32/68 | ◎◎ | ◎◎◎ |
| Example 11 | P-11 | 4 | C-1 | 6 | 90 | 40/60 | ◎◎ | ◎◎◎ |
| Example 12 | P-12 | 4.5 | C-1 | 5.5 | 90 | 45/55 | ◎◎ | ◎◎◎ |
| Example 13 | P-13 | 5.2 | C-1 | 4.8 | 90 | 52/48 | ◎◎ | ◎◎◎ |
| Example 14 | P-14 | 5 | C-1 | 5 | 90 | 50/50 | ◎◎ | ◎◎◎ |
| Example 15 | P-15 | 5 | C-1 | 5 | 90 | 50/50 | ◎◎ | ◎◎◎ |
| Example 16 | P-16 | 5 | C-1 | 5 | 90 | 50/50 | ◎◎ | ◎◎◎ |
| Example 17 | P-17 | 5 | C-1 | 5 | 90 | 50/50 | ◎◎ | ◎◎◎ |
| Example 18 | P-18 | 5 | C-1 | 5 | 90 | 50/50 | ◎◎ | ◎◎◎ |
| Example 19 | P-19 | 5 | C-1 | 5 | 90 | 50/50 | ◎◎ | ◎◎◎ |
| Example 20 | P-3 | 3.5 | C-1 | 6.5 | 90 | 35/65 | ◎◎ | ◎◎◎ |
| Example 21 | P-3 | 5 | C-2 | 5 | 90 | 50/50 | ◎◎ | ◎◎◎ |
| Example 22 | P-3 | 5 | C-1 | 3.75 | 90 | 50/50 | ◎◎ | ◎◎◎ |
| | | | C-2 | 1.25 | | | ◎◎ | ◎◎◎ |
| Example 23 | P-3 | 5 | C-1 | 3.75 | 90 | 50/50 | ◎◎ | ◎◎◎ |
| | | | C-3 | 1.25 | | | ◎◎ | ◎◎◎ |

TABLE 2-continued

| | Inorganic fiber sizing agent-containing composition | | | | | Polyamide compound/ nitrogen-containing compound | Evaluation | |
|---|---|---|---|---|---|---|---|---|
| | Inorganic fiber sizing agent | | | | | | | |
| | Polyamide compound | | Nitrogen-containing compound | | Water | (Mass | Heat | Long-term |
| Section | Type | Part | Type | Part | Part | ratio) | resistance | stability |
| Example 24 | P-3 | 5 | C-2 | 3.75 | 90 | 50/50 | ◎◎ | ◎◎◎ |
| | | | C-3 | 1.25 | | | ◎◎ | ◎◎◎ |
| Example 25 | P-3 | 15 | C-1 | 15 | 70 | 50/50 | ◎◎ | ◎◎◎ |
| Example 26 | P-3 | 40 | C-1 | 40 | 20 | 50/50 | ◎◎ | ◎◎◎ |
| Example 27 | P-20 | 5 | C-1 | 5 | 90 | 50/50 | ◎ | ◎◎◎ |
| Example 28 | P-21 | 5 | C-1 | 5 | 90 | 50/50 | ◎ | ◎◎◎ |
| Example 29 | P-22 | 5 | C-1 | 5 | 90 | 50/50 | ○ | ◎◎◎ |
| Example 30 | P-3 | 5 | C-3 | 5 | 90 | 50/50 | ◎◎ | ◎◎ |
| Example 31 | P-3 | 5 | C-4 | 5 | 90 | 50/50 | ◎◎ | ◎◎ |
| Example 32 | P-3 | 5 | C-5 | 5 | 90 | 50/50 | ◎◎ | ◎◎ |
| Example 33 | P-3 | 5 | C-6 | 5 | 90 | 50/50 | ◎◎ | ◎◎ |
| Example 34 | P-3 | 3 | C-1 | 7 | 90 | 30/70 | ◎◎ | ◎◎ |
| Example 35 | P-3 | 5.5 | C-1 | 4.5 | 90 | 55/45 | ◎◎ | ◎◎ |
| Example 36 | P-3 | 2.5 | C-1 | 2.5 | 95 | 50/50 | ◎◎ | ◎◎ |
| Example 37 | P-3 | 3 | C-3 | 7 | 90 | 30/70 | ◎◎ | ◎ |
| Example 38 | P-3 | 42.5 | C-3 | 42.5 | 15 | 50/50 | ◎◎ | ◎ |
| Example 39 | P-3 | 1.5 | C-1 | 3.5 | 95 | 30/70 | ◎◎ | ◎ |
| Example 40 | P-3 | 46.75 | C-3 | 38.25 | 15 | 55/45 | ◎◎ | ○ |
| Example 41 | P-20 | 46.75 | C-3 | 38.25 | 15 | 55/45 | ◎ | ○ |
| Example 42 | P-21 | 46.75 | C-3 | 38.25 | 15 | 55/45 | ◎ | ○ |
| Example 43 | P-22 | 46.75 | C-3 | 38.25 | 15 | 55/45 | ○ | ○ |
| Example 44 | P-16 | 3 | C-1 | 7 | 90 | 30/70 | ◎◎ | ◎◎ |
| Example 45 | P-16 | 5.5 | C-1 | 4.5 | 90 | 55/45 | ◎◎ | ◎◎ |
| Example 46 | P-18 | 3 | C-1 | 7 | 90 | 30/70 | ◎◎ | ◎◎ |
| Example 47 | P-18 | 5.5 | C-1 | 4.5 | 90 | 55/45 | ◎◎ | ◎◎ |
| Example 48 | P-22 | 3 | C-1 | 7 | 90 | 30/70 | ○ | ◎◎ |
| Example 49 | P-22 | 5.5 | C-1 | 4.5 | 90 | 55/45 | ○ | ◎◎ |
| Comparative Example 1 | rp-1 | 5 | C-1 | 5 | 90 | 50/50 | ◎◎ | X |
| Comparative Example 2 | rp-2 | 5 | C-1 | 5 | 90 | 50/50 | ◎◎ | X |
| Comparative Example 3 | rp-2 | 6 | C-3 | 4 | 90 | 60/40 | ◎◎ | X |
| Comparative Example 4 | rp-3 | 5 | C-1 | 5 | 90 | 50/50 | X | ◎◎◎ |
| Comparative Example 5 | P-3 | 5 | rc-1 | 5 | 90 | 50/50 | Unmeasurable | XX |
| Comparative Example 6 | P-3 | 10 | — | — | 90 | 100/0 | Unmeasurable | XX |

The details of the nitrogen-containing compounds listed in Table 2 are as follows:

C-1: 1,2-Dimethylimidazole
C-2: 1-Piperidineethanol
C-3: Dimethylaminoethanol
C-4: Diethylaminoethanol
C-5: 1-Methylpyrrolidone
C-6: Ammonia
rc-1: NaOH

Experimental Part 2 (Evaluation of Long-Term Stability)

Long-Term Stability of Sizing Agent Composition

The sizing agent composition of each example was allowed to stand at 25° C. for 6 months. After the standing period, the appearance of the sizing agent composition was visually observed and evaluated according to the following criteria. The results are shown in the column "long-term stability" in Table 2.

◎◎◎ (Very excellent): No precipitation, separation, or gelation occurs even after 6 months.

◎◎ (Excellent): No precipitation, separation, or gelation occurs even after 3 months, but precipitation, separation, or gelation occurs after 6 months.

◎ (Good): No precipitation, separation, or gelation occurs even after 1 month, but precipitation, separation, or gelation occurs after 3 months.

○ (Acceptable): No precipitation, separation, or gelation occurs even after 2 weeks, but precipitation, separation, or gelation occurs after 1 month.

x (Poor): Precipitation, separation, or gelation occurs after 2 weeks.

xx (Very poor): Precipitation or separation occurs immediately after preparation.

Heat Resistance Evaluation

The sizing agent composition of each example was dried at 200° C. for 1 hour to obtain a solid content. One gram of the solid content was sampled in an aluminum cup with a diameter of 50 mm, and then treated in an electric furnace at 400° C. for 30 minutes. The residual rate (%) was calculated using the following formula:

$$\text{Residual rate (\%)} = (\text{Mass after treatment})/(\text{Mass before treatment}) \times 100$$

The heat resistance was evaluated according to the following criteria. The results are shown in the column "heat resistance" in Table 2.

◎◎ (Excellent): The residual rate is 90% or more.

◎ (Good): The residual rate is 85% or more and less than 90%.

○ (Acceptable): The residual rate is 75% or more and less than 85%.

x (Poor): The residual rate is less than 75%.

As is apparent from the results in Table 2, the present invention succeeds in providing a sizing agent composition capable of forming a polyimide film with excellent heat resistance. In addition, high stability can be maintained even when the sizing agent composition is stored for a long period of time. The sizing agent compositions of Comparative Examples 5 and 6 had very poor stability, making uniform sampling difficult; therefore, heat resistance could not be measured or evaluated. It is considered that in the sizing agent compositions of Comparative Examples 5 and 6, the formation of a polyamic acid, in which the constituent unit A and the constituent unit B are polymerized via amide bonds, did not proceed sufficiently.

The invention claimed is:

1. An inorganic fiber sizing agent-containing composition comprising an inorganic fiber sizing agent and water, wherein the inorganic fiber sizing agent contains a polyamide compound composed of a constituent unit A and a constituent unit B, and a nitrogen-containing compound, the molar ratio of the constituent unit A to the constituent unit B is constituent unit A/constituent unit B=49.0/51.0 to 43.0/57.0, the constituent unit A includes a constituent unit formed from a tetracarboxylic acid or a derivative thereof, the constituent unit B includes a constituent unit formed from a diamine or a derivative thereof, the nitrogen-containing compound is at least one selected from the group consisting of ammonia, a tertiary amine compound, and an aprotic nitrogen-containing heterocyclic compound, and the mass ratio of the polyamide compound content to the nitrogen-containing compound content in the inorganic fiber sizing agent-containing composition is polyamide compound/nitrogen-containing compound=54/46 to 31/69.

2. The inorganic fiber sizing agent-containing composition according to claim 1, wherein the constituent unit A includes a constituent unit formed from a tetracarboxylic acid having an aromatic group or a derivative thereof.

3. The inorganic fiber sizing agent-containing composition according to claim 1, wherein the constituent unit B includes a constituent unit formed from a diamine having an aromatic group or a derivative thereof.

4. The inorganic fiber sizing agent-containing composition according to claim 1, wherein the nitrogen-containing compound includes at least one selected from the group consisting of 1,2-dimethylimidazole and 1-piperidineethanol.

5. The inorganic fiber sizing agent-containing composition according to claim 1, wherein the mass ratio of the inorganic fiber sizing agent to the water in the inorganic fiber sizing agent-containing composition is inorganic fiber sizing agent/water=10/90 to 80/20.

6. The inorganic fiber sizing agent-containing composition according to claim 1, wherein the inorganic fiber sizing agent-containing composition is applied to a carbon fiber.

7. A method for producing an inorganic fiber, comprising adhering the inorganic fiber sizing agent-containing composition according to claim 1 to an inorganic fiber.

8. The method for producing an inorganic fiber according to claim 7, wherein the inorganic fiber is a carbon fiber strand.

* * * * *